United States Patent [19]

Breslow et al.

[11] 3,980,305

[45] Sept. 14, 1976

[54] SIMULATED BOWLING APPARATUS

[75] Inventors: Jeffrey D. Breslow, Highland Park; Eugene Jaworski, Park Ridge, both of Ill.

[73] Assignee: Marvin Glass & Associates, Chicago, Ill.

[22] Filed: Feb. 13, 1975

[21] Appl. No.: 549,483

[52] U.S. Cl. ..... 273/102 AP; 273/41; 273/127 D; 273/85 R

[51] Int. Cl.[2] ..... A63B 71/02

[58] Field of Search ..... 273/41, 95 R, 102 R, 273/102.1 R, 102.1 C, 102.1 G, 102.1 F, 105.2, 105.6, 127 R, 127 D, 102 AP, 85 R

[56] References Cited

UNITED STATES PATENTS

| | | | |
|---|---|---|---|
| 855,455 | 6/1907 | Greer | 273/41 |
| 1,079,678 | 11/1913 | West | 273/102 R |
| 1,321,593 | 11/1919 | Bulfinch | 273/41 |
| 2,905,469 | 9/1959 | Taylor | 273/102 AP |
| 2,990,175 | 6/1961 | Stunkel | 273/41 |
| 3,844,559 | 10/1974 | Davidson | 273/127 D |

*Primary Examiner*—Richard C. Pinkham
*Assistant Examiner*—Marvin Siskind
*Attorney, Agent, or Firm*—Coffee & Sweeney

[57] ABSTRACT

A target game for simulating a bowling game including a ball and a plurality of simulated bowling pins mounted in a circular arrangement about an opening provided in the front face of a substantially vertical frame structure. Each bowling pin is individually pivotally mounted to the frame so that the longitudinal axis of all of the pins are directed radially into an open space in the center of the frame opening defined by the heads of the pins and of a lesser diameter than the ball. The pins are movable from a "set" vertical disposition wherein all of the pins lie generally in the vertical plane of the front face of the frame structure to a "knocked-down" horizontal disposition wherein all of the pins are substantially horizontal or perpendicular to the front face. The ball is thrown through the air by one of the player's of the game toward the center of the opening where it is possible to simultaneously hit the center heads of all of the pins to thereby move them to the knocked-down position which could be scored as a strike. If the bowling ball is not thrown exactly on center, fewer than all of the pins will be moved to their knocked-down horizontal position and the player may be permitted a second attempt to knock down the remaining pins, which could be scored as a "spare" if he does so. After a player's turn, all of the pins are manually returned to the set position for the next player.

6 Claims, 5 Drawing Figures

SIMULATED BOWLING APPARATUS

BACKGROUND AND SUMMARY OF THE INVENTION

The present invention relates to a target game apparatus and more particularly to a bowling type game having pivotally mounted pins which can be easily reset. Simulated bowling games of the type which may be used in a room or arcade have been well received by the public. A common example of this type of bowling game is a coin operated machine having the pins pivotally mounted to a frame above a simulated bowling alley wherein the alley surface, under the pins, includes a number of feelers associated with the pins to cause them to be retracted as a bowling ball or puck passes over the feelers.

The object of the present invention is to provide a novel and improved target game apparatus simulating a bowling game, but employing a new approach thereto, and which is inexpensive to manufacture and yet durable enough for continued and lasting use.

In accordance with the objects of the present invention the target game includes a substantially vertical frame having a plurality of target members in the form of simulated bowling pins pivotally mounted thereto in a circular arrangement within an aperture provided in the frame. The target members are movable between a first, vertical set position when the pins lie substantially in one plane in a vertical front face of the frame, and a second, knocked-down position wherein the target members are substantially horizontal or perpendicular to the front face of the frame. The game includes cam means for maintaining the target members in either the vertical set position or the horizontal knocked-down positions. A projectile in the form of a ball is propelled by one of the players of the game through the air at the frame in an attempt to move the target members from the vertical set position to the horizontal knocked-down position. After one player has attempted to knock down the target members, they are manually reset for the next player of the game.

Other objects, features and advantages of the invention will be apparent from the following detailed description taken in connection with the accompanying drawings.

DESCRIPTION OF THE PREFERRED EMBODIMENT

Figure 1:
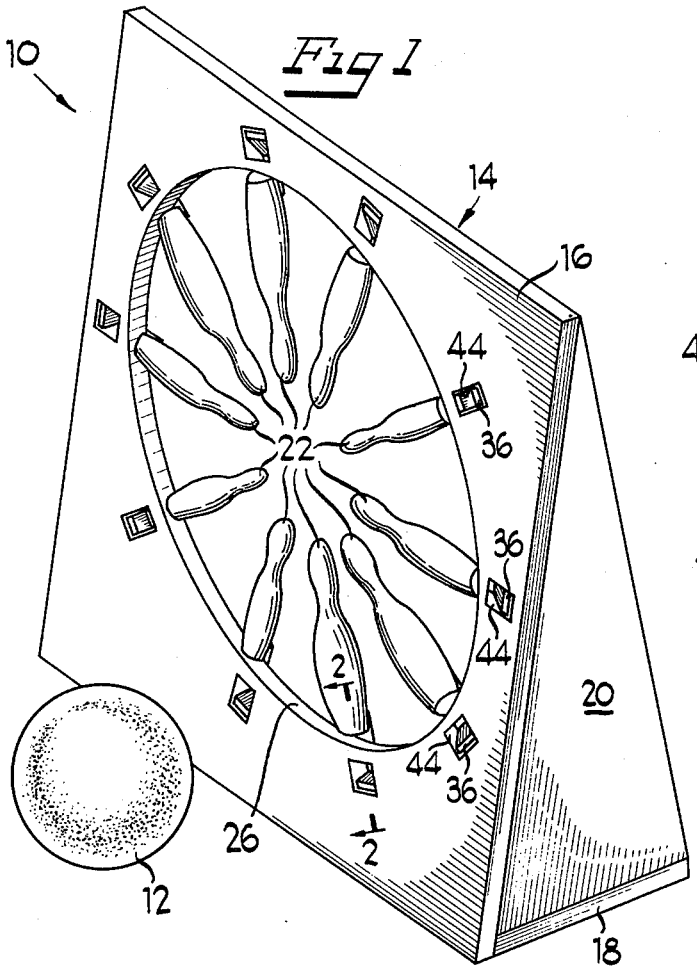
FIG. 1 is a perspective view of the game apparatus of the present invention.

The game apparatus of the present invention, generally designated 10 in FIG. 1, includes a projectile in the form of a ball 12 and a target structure, generally designated 14. The ball 12 can be made of a variety of materials, but preferably of a material and size so that it can be thrown through the air toward the target structure.

The target structure 14 includes a substantially vertical frame member 16 which defines a front face and which is supported by a flat base 18 extending rearwardly from the bottom edge of the frame 16. Strengthening side flanges 20 are provided between the base 18 and the frame 16 to give added rigidity to the frame. A plurality of target members 22 in the form and shape of bowling pins are pivotally mounted to the frame 16. The pins 22 are mounted in a circular arrangement within a large diameter aperture 26 formed within the frame 16. The pins are mounted radially with the top "head" of each pin converging inwardly to provide a target hole within the center of all of the pins. The ball 12 is of a larger diameter than the target hole so that it can simultaneously contact the heads of all of the bowling pins.

The pins 22 are pivotally mounted so each are movable between a vertical set position, as shown in FIG. 1, where all of the pins lie substantially within the vertical plane of the frame 16 and a knocked-down position (FIG. 3) wherein the pins are pivoted approximately 90° so as to be horizontal or perpendicular with the front face of the frame 16.

Each of the pins includes retaining means for holding the pin in either the set or knocked-down positions. More particularly, referring to one of the retaining means (FIGS. 2 through 5), each pin 22 is mounted to a support bracket, generally designated 30. The support bracket, referring to FIG. 2, includes an arm 32 having a generally forwardly directed flange 34 for attachment to the respective pin 22. The flange 34 can be secured to the pin 22 by glue, or preferably by molding the support bracket 30 integrally with the pin 22. The other end of the arm 32 mounts a reset tab 36 generally at an angle thereto for manual resetting of the pins, as will be described in detail hereinafter.

Figure 4:
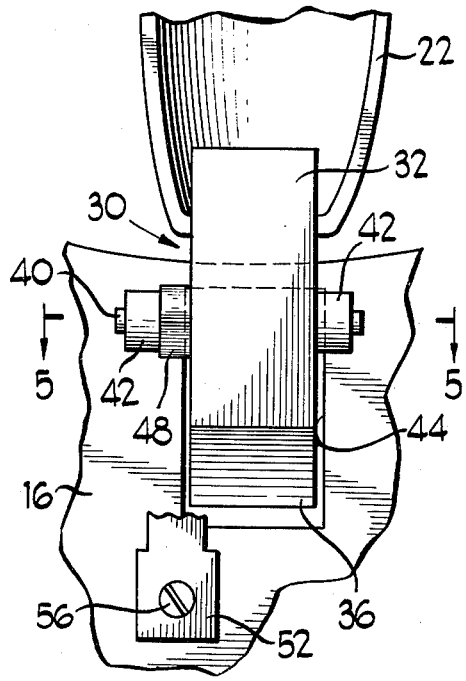
FIG. 4 is a partial rear elevational view, taken generally in the direction of line 4—4 of FIG. 2.
Figure 5:
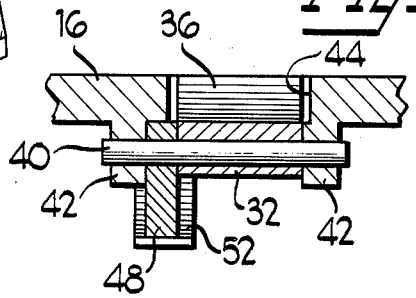
FIG. 5 is a generally horizontal section through the retaining cam means for the pin, taken generally along the line 5—5 of FIG. 4.
Figure 2:
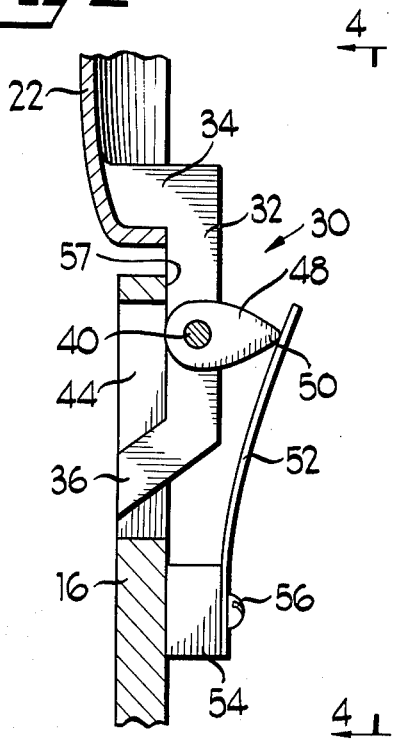
FIG. 2 is a generally vertical section, on an enlarged scale, taken generally along the line 2—2 of FIG. 1, with the pin in its set position.
Figure 3:
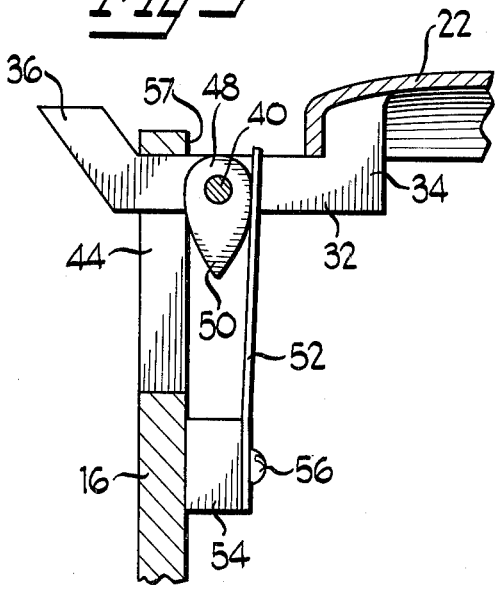
FIG. 3 is another section similar to that of FIG. 2, with the pin moved to the horizontal knocked-down position.

Referring to FIGS. 4 and 5, each support bracket 30 is pivotally mounted by an axle 40 in a pair of axle journals 42 mounted on the rearward surface of the frame 16. The journals 42 are mounted adjacent a generally rectangular opening 44 in the frame which permits the reset tab 36 to extend therethrough when the pin is in the knocked-down position, for subsequent manually resetting of the pins. The axle 40 is secured to the support bracket 30 to rotate therewith and carries a single lobed cam 48 for conjoint rotation with the support bracket 30 and pin 22. The cam 48 includes a single lobe or point 50 which is directed generally horizontally and rearwardly when the pin 22 is in the vertical set position, as shown in FIGS. 1 and 2. When the pin 22 is moved to the knocked-down position by the ball 12, the lobe 50 of the cam 48 is directed generally downwardly, as shown in FIG. 3.

Resilient means in the form of a leaf spring 52 is mounted for engagement with the surface of the cam 48 by a rearwardly directed post 54 on the frame 16 and a screw 56. Referring to FIG. 2, when the pins 22 are in their set position, the lobe or point 50 of the cam 48 engages the leaf spring 52 and flexes it rearwardly as seen in FIG. 2. This holds the pin in its set position against an abutment stop surface 57 of the frame 16. FIG. 3 shows the pin 22 in its knocked-down position and the leaf spring 52 is now in engagement with the generally circular portion of the cam 48 since the point 50 has moved to a generally downward position.

Thus, in operation, the pins 22 will be held in their set positions by the leaf spring 52 engaging the cam lobe 50 and biasing the respective pin against the abutment surface 57. However, force on any portion of a pin 22 will cause the pin to rotate and thus cause the cam lobe 50 to slide along the retaining spring 52. Once the cam lobe 50 passes a point of tangential relationship with the spring 52, the spring then will flex inwardly thereby continuing the rotation of the pin to its knocked-down position as shown in FIG. 3. This cam and spring combination is particularly necessary for the pins located on the upper half of the aperture 24 to overcome the gravitational forces which tend to maintain the pins within the plane of the frame 16.

The pins 22 will be held in the knocked-down position by the cam 50 and leaf spring 52 until they are reset by the players of the game. The pins are reset by depressing the reset tabs 36 back into a flush relationship with the frame 16 where they again are held by the cam 48 and leaf spring 52.

In one scheme of play of the game, the same rules which apply to bowling are used. The player has two opportunities to attempt to knock all of the pins down. If he knocks all of the pins down with just one throw of the ball 12, he is awarded a strike, as in bowling. If some of the pins remain in the set position after the first throw, a player may be permitted to have a second throw, in which case, if he knocks down all of the remaining pins, he may be awarded a spare. Any other combination of less than all of the pins award the player the number of points equal to the number of pins knocked down. Of course, many other variations in the rules are possible without departing from the spirit of the present invention.

The foregoing detailed description has been given for clearness of understanding only and no unnecessary limitations should be understood therefrom as some modifications will be obvious to those skilled in the art.

We claim:

1. A simulated bowling game apparatus comprising:

a frame having a substantially vertical target support portion having an opening therein;

a plurality of simulated bowling targets pivotally mounted on the target support portion radially within said opening with their free head ends radially converging, said targets being movable between a first, vertical set position and a second, horizontal knocked down position;

means for maintaining said targets in said first position whereat only a small predetermined force is required to initiate movement to said second position or in said second position whereat a force substantially larger than said predetermined force is required to initiate movement back to said first position; and a projectile to be propelled through the air by a user of the game at the targets for moving the targets from said first to said second positions wherein the free ends of the targets are cumulatively spaced about a space smaller in diameter than said projectile.

2. The game apparatus of claim 1 wherein the means for maintaining the targets in either the set or knocked-down positions comprises cam means mounted on the pivotal axis of each target.

3. The bowling game apparatus of claim 2 wherein the cam means includes a single lobed cam mounted on said axis in engagement with a flat resiliently flexible leaf spring mounted on the frame so as to constantly engage said cam to hold the targets in said unstable set or stable knocked down position.

4. The bowling game apparatus of claim 3 wherein the lobe of the cam tangentially contacts the flat resilient leaf spring when said targets are in said first set position so that a relatively small force is required to cause said target to move and said lobe moves out of engagement with the retaining means to permit the resilient leaf spring to act as a driving force to move a target which has been contacted by the ball, to the end of its travel and maintain the target thereat in the knocked-down position.

5. A simulated bowling game apparatus, comprising:

a frame having a generally vertical target support portion having an opening therein;

a plurality of targets pivotally mounted on the target support portion in a circular arrangement within said opening with free ends thereof radially converging, said targets being movable between a first generally vertical set position, and a second generally horizontal "knocked-down" position;

means for maintaining said targets in either the first or second position;

a projectile to be propelled through the air by a user of the game at the targets, for moving the targets from said first position to said second position;

a plurality of apertures formed in the target support frame, one aperture being adjacent each of said pivotally mounted targets; and a reset member secured to each of said targets, said reset members protruding through the respective apertures in front of said target support portion when the targets are in their knocked-down position to permit independent, selective manual moving by the players of the game of a target from its knocked-down position back to its set position.

6. The game apparatus of claim 5 wherein said reset members include a stop surface for engaging the frame to maintain the targets in their horizontal position after being knocked down.

* * * * *